United States Patent [19]

Beneze et al.

[11] Patent Number: 4,532,744

[45] Date of Patent: Aug. 6, 1985

[54] LOCKING DEVICE FOR MEMBRANE FASTENER APPARATUS

[75] Inventors: Heinz W. Beneze, Akron; Walter Tomaszewski, Canton, both of Ohio

[73] Assignee: The Firestone Tire & Rubber Company, Akron, Ohio

[21] Appl. No.: 529,468

[22] Filed: Sep. 6, 1983

[51] Int. Cl.[3] ..... E04B 1/00

[52] U.S. Cl. ..... 52/222; 52/410; 52/710; 160/395

[58] Field of Search ..... 52/410, 409, 222, 273, 52/465, 468, 710, 716, 718; 24/573, 459–462, 590; 160/392, 395, 397

[56] References Cited

U.S. PATENT DOCUMENTS

| | | | |
|---|---|---|---|
| 1,484,382 | 2/1924 | Allitt | 160/392 |
| 2,164,414 | 7/1939 | Long | 244/132 |
| 3,166,117 | 1/1965 | Abadjieff | 160/395 |
| 3,205,001 | 9/1965 | Abolins | 52/222 |
| 3,757,479 | 9/1973 | Martinez | 52/222 |
| 3,928,897 | 12/1975 | Tombu | 24/243 K |
| 4,473,982 | 10/1984 | Monari | 52/222 |

FOREIGN PATENT DOCUMENTS

| | | | |
|---|---|---|---|
| 576826 | 3/1958 | Italy | 24/590 |

OTHER PUBLICATIONS

U.S. Ser. No. 516,622 filed Jul. 25, 1983, entitled Mechanical Fastening System—James H. C. Yang et al.

U.S. Ser. No. 516,618 filed Jul. 25, 1983, entitled Attachment Device for Securing Flexible Sheets—James H. C. Yang et al.

U.S. Ser. No. 524,511 filed Aug. 18, 1983, entitled Membrane Fastener Apparatus—Charles S. Dubich et al.

*Primary Examiner*—John E. Murtagh
*Assistant Examiner*—Kathryn Ford
*Attorney, Agent, or Firm*—Ernst H. Ruf

[57] ABSTRACT

In an attachment device, comprising a channel member and an insert member, for securing an elastic membrane within the channel member via the insert member, one of the insert and channel members being capable of deformation to permit the insertion of the insert member, together with adjacent portions of the elastic membrane, into the channel member, the improvement, taking the form of a locking device, insertable into the channel member to prohibit the subsequent removal of the elastic membrane by elastic deformation of one of the channel and insert members.

12 Claims, 4 Drawing Figures

LOCKING DEVICE FOR MEMBRANE FASTENER APPARATUS

TECHNICAL FIELD

The field of art to which the locking device of this invention pertains is that of mechanical fastening systems, particularly to attachment devices for mechanically securing a flexible sheet, without puncturing same, within a channel member via either a flexible resilient insert member or a ductile rigid insert member, adapted for fixedly retaining the flexible sheet within the channel member.

BACKGROUND OF THE ART

A large number of commercial and factory or plant roofs are of a flat roof design wherein the roofing material itself is often of built-up asphalt, and, in more modern systems, of a single ply EPDM elastomeric sheet or membrane. In terms of securing a single ply EPDM membrane to the roof itself, one common design utilized is the mechanical ballast system that uses a layer of stone over the membrane. While the ballast system is least expensive, it has the disadvantage of being quite heavy (about ten pounds per square foot) thus requiring a heavy roof support structure and, in addition, the roof slope cannot exceed 10°.

Adhered roof membrane retention system suffer from a cost penalty while mechanical fastening systems generally require a fixation to the roof substrate by metal fasteners with metal or rubberized nailing strips. Additional sealing strips or caps are then required to keep the punctured membrane water tight. Such installations are cumbersome as well as time consuming in addition to violating the integrity of the membrane itself.

Co-pending U.S. application Ser. No. 516,618 to Yang, et al, filed July 25, 1983, and assigned to common assignee, discloses a mechanical fastening system for securing a flexible sheet within a channel member via an insert member wherein the latter is made of flexible resilient material having a central longitudinal flex notch that serves to define two adjacent wing portions and permits a temporary elastic deformation of the insert member into an inverted V-shape for insertion of the insert member, together with adjacent portions of the flexible sheet, into the channel member. In the interest of full disclosure, this application is incorporated herein by reference to the extent necessary to explain this particular mechanical fastening system.

Co-pending U.S. application Ser. No. 524,511 to Dubich, et al, filed Aug. 18, 1983, and assigned to common assignee, discloses a membrane fastener apparatus, including a placing tool assembly that sequentially horizontally deforms the flexible resilient strip into an inverted V-shape; thereafter, grips the apex portion of the inverted V-shaped strip and pushes the strip, together with the abutting portions of the flexible membrane, into the channel member. Subsequently, a pressing tool assembly contacts the apex portion of the inverted V-shaped insert strip to both fully insert the strip into the channel member and thereafter return the strip to approximately its natural shape, so as to frictionally and non-bindingly retain adjacent portions of the membrane within the channel member. To the extent necessary, this application is also incorporated herein by reference in the interest of full disclosure.

Co-pending U.S. application Ser. No. 516,622 to Yang, et al, filed July 25, 1983 and assigned to common assignee, discloses an attachment device for securing flexible sheets within a channel member via an insert member of generally inverted V-shape wherein the latter is made of ductile but rigid material having a central longitudinal portion of reduced rigidity that serves to define two adjacent wing portions and permits the subsequent plastic deformation of the insert member into its installed shape after its insertion, together with adjacent portions of the flexible sheet, into the channel member. Again, in the interest of full disclosure, this application is incorporated herein by reference to the extent necessary to explain this particular attachment device.

In both the previously-noted mechanical fastening system and attachment device, the insert member serves to retain adjacent portions of the flexible membrane within the channel member. Under normal design conditions, these insert members fully perform their function of retaining the flexible membrane within the channel member. It is conceivable, however, that excess force or pressure could possibly cause sufficient deformation of either the channel member or insert member so as to cause the removal of the insert member from the channel member and thereafter permit the removal of the flexible sheet from the channel member.

DISCLOSURE OF THE INVENTION

The present invention provides a solution to the prior art problem of possible removal of the insert member from the channel member by utilizing a locking device that can be inserted into the channel member, and angularly displaced therein, after the installation of the membrane and insert member to positively, mechanically lock the insert member, and subsequently the flexible membrane, within the channel member.

The locking device of the present invention is preferably made of a rigid material that is substantially flat and is adapted to be initially inserted in close but noninterfering relation into the channel member.

The locking device has a pre-determined length greater than its width but less than the width of the channel member so as to permit the angular displacement thereof within the channel member. Preferably, the locking device has a pair of parallel sides and the pair of sides forming opposed arcs of a circle, the latter causing a minimum of material displacement as a result of the angular displacement of the locking device within the channel member.

In order to permit the noted angular displacement, the locking device is provided with a shaped opening for the insertion of a conjugate-shaped turning tool.

Other features and advantages of the present invention will become more readily understood by persons skilled in the art when following the best mode description in conjunction with the several drawings.

BEST MODE FOR CARRYING OUT THE INVENTION

Figure 1:
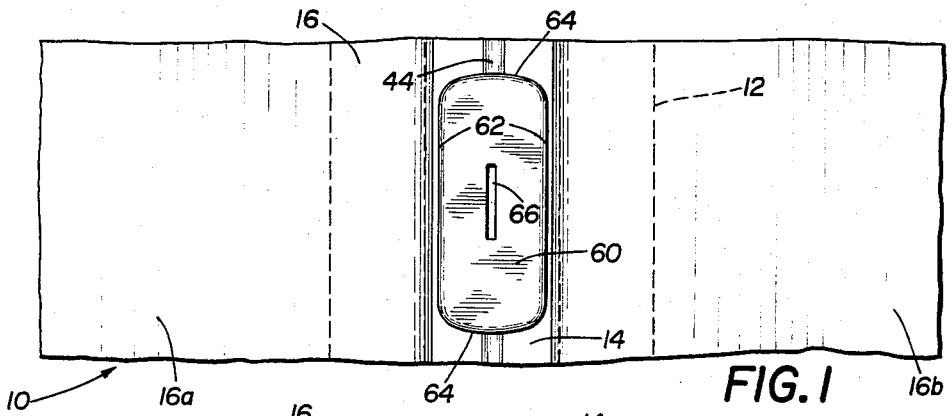
FIG. 1 is a fragmentary top plan view of the locking device of the present invention inserted into a membrane fastener apparatus, but not yet placed in its locking position.
Figure 2:
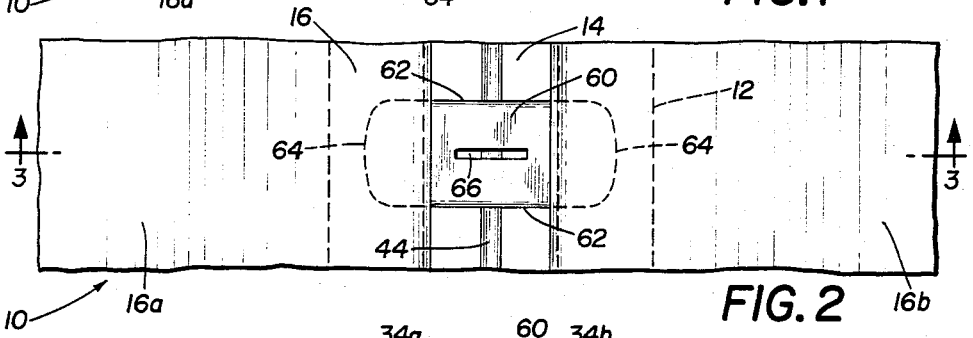
FIG. 2 is a view similar to that of FIG. 1 but showing the locking device angularly displaced into its locking position.
Figure 3:
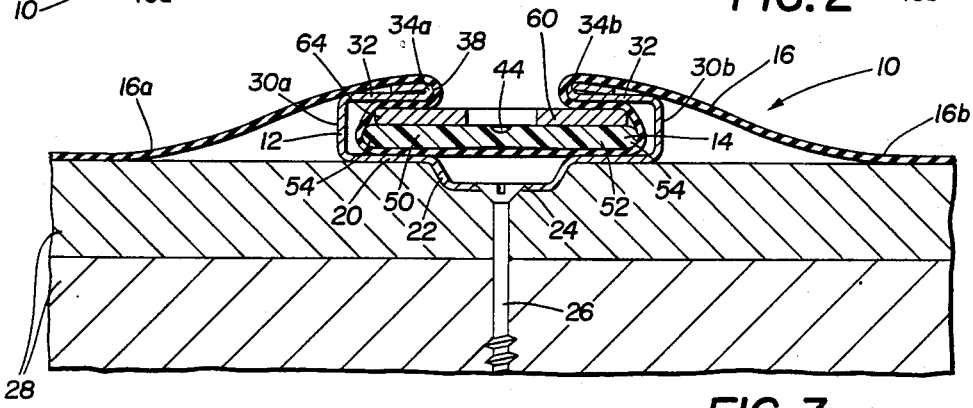
FIG. 3 is a cross-sectional view taken substantially on the plane indicated by lines 3—3 in FIG. 2.

Referring now to the drawings, specifically FIGS. 1–3, there is illustrated a known attachment device 10, including channel member 12 and insert member 14, which is utilized for securing a portion of a flexible sheet 16, interposed therebetween, in a manner to be described hereinafter.

Channel member 12, as best shown in FIG. 3, and usually of a rigid, preferably metal construction, is of generally rectangular form in transverse cross-section, as shown, having a substantially flat bottom wall 20 which in turn is provided with a plurality (one shown) of longitudinally spaced outwardly directed protrusions or recesses 22 that are provided with a central aperture 24, the latter permitting the partial passage therethrough of a fastener, such as 26. The ends of channel bottom wall 20 merge into opposed, similarly projecting sidewalls 30*a*, 30*b*, which in turn merge into inwardly converging spaced top wall 32, parallel to bottom wall 20, whose opposite inner but spaced smooth edges 34*a*, 34*b* serve to define a constricted central longitudinal slot or opening 38 of a predetermined width.

In order to permit the insertion of sheet 16 into the interior of channel member 12, sheet 16 must be at least flexible and is preferably elastic. Sheet or membrane 16 may be EPDM (Ethylene Propylene Diene Monomer) roofing sheeting of a predetermined thickness.

Insert member 14, is preferably constructed of a flexible resilient material such as, for example, Sentoprene®103-40, a thermoplastic rubber distributed by the Monsanto Company, Rubber Chemical Division, in Akron, Ohio. Other plastic, elastomeric or rubber-type materials can be utilized. Even rigid materials can be utilized, especially if channel member 16 is constructed of a resilient material. Insert member 14, which is either flat, i.e., of generally rectangular form, in transverse cross-section or preferably of generally concavely curved form in transverse cross-section, has a central longitudinal flex notch 44 on its top surface that serves to define two adjacent substantially similar wing portions 50, 52 of predetermined thickness and having smoothly radiused ends 54. Flex notch 44 not only serves to define the two adjacent wing portions 50, 52, but also permits the temporary elastic deformation of insert member 14 into an inverted V-shape for insertion of member 14, together with adjacent portions of flexible sheet 16, into channel member 12.

Turning now specifically to FIG. 3, it depicts channel member 12 attached to any desired type of substrate 28, such as a roofing structure, via plurality of fasteners 26. After flexible sheet or membrane 16 is placed over channel member 12, insert member 14 is temporarily elastically deformed into an inverted V-shape by pressing wing portions 50, 52 together, wherein the bottom surface of insert member 14 defines the inner surface of the inverted V. Insert member 14, then in its inverted V-shape, together with adjacent portions of sheet 16, is then pushed or placed vertically into channel member 12 through central longitudinal opening 38 until sheet 16 touches channel member bottom wall 20. Thereafter, pressure is applied downwardly against the now-deformed flex notch 44 (forming the apex of the inverted V) to flatten or return insert member 14 from its inverted V-shape to approximately its natural shape—either substantially flat or to a slightly concave shape. The important thing is that after insert member 14 is received within channel member 12, that it must either remain substantially flat or slightly concave since a convex curvature can cause it to be ejected from channel member 12 upon the application of sufficient tensile forces, either parallel and/or perpendicular to top wall 32, on either one or both of sheet ends 16*a*, 16*b*.

It is believed that the mode of operation of insert member 14 consists of the fact that when a tensile force acts at one of membrane ends 16*a*, 16*b*, either parallel to or perpendicular to top wall 32, this tensile force is transmitted, by insert member 14, acting as a beam, to the opposite end of the insert member to thereby press its associated portion of sheet 16 against the inner surface of channel member wall portion 30*a*, 30*b*. The frictional forces present between these parts, when in contact with each other, prevent membrane 16 from sliding out of channel member 12 after insert member 14 is inserted. If perpendicular or opposed parallel tensile forces are applied on both membrane ends 16*a*, 16*b*, insert member 14 is drawn upward so that membrane 16 is frictionally retained between member 14 and the inner surface of top wall 32 and the bottom wall portion, in at least the area below notch 44, will retain membrane 16 against bottom wall 20. There can be a limited amount of lateral and/or vertical shifting of sheet 16 and member 14 within channel member 12.

Under normal operating conditions, insert member 14 will serve to retain associated portions of membrane 16 within channel member 12. In order to absolutely ensure the retention of insert member 14, and subsequently membrane 16, within channel member 12, the present invention contemplates the use of a locking device 60, preferably of a rigid material, with locking device 60 preferably being substantially flat. As best seen in FIG. 1, locking device 60 is essentially substantially rectangular, with radiused corners, but preferably has a pair of parallel sides 62 and a pair of sides 64 forming opposed arcs of a circle. The width of locking device 60, i.e. the space between parallel sides 62 is such that it permits a close but non-interfering insertion into channel member 12 through slot 38 after membrane 16 has been retained in channel member 12 by insert member 14. In addition, the length of locking device 60, i.e. the distance between sides 64, is of course greater than its width but less than the width of channel member 12. Furthermore, locking device 60, which may be of any desired type of rigid material, such as metal or plastic, for example, is preferably provided with a central, shaped opening that permits the insertion of a conjugate-shaped turning tool (not shown). For example, central opening 66 may take the form of a slot that would permit the insertion of a slotted head screwdriver which is then utilized for angularly displacing, via turning or pivoting, locking device 60 from the position shown in FIG. 1, wherein its parallel sidewalls 62 are parallel with channel member opening 38, to the position in FIG. 2 wherein locking device 60 has been displaced approximately 90° so that its sides 64 are now interposed between insert member 14 and membrane 16 underneath channel member top wall 32, as best shown in FIG. 3. The angular displacement of locking device 60 from the FIG. 1 to the FIG. 2 position of course prohibits the subsequent removal of flexible membrane 16 due to any elastic deformation of insert member 14.

Figure 4:
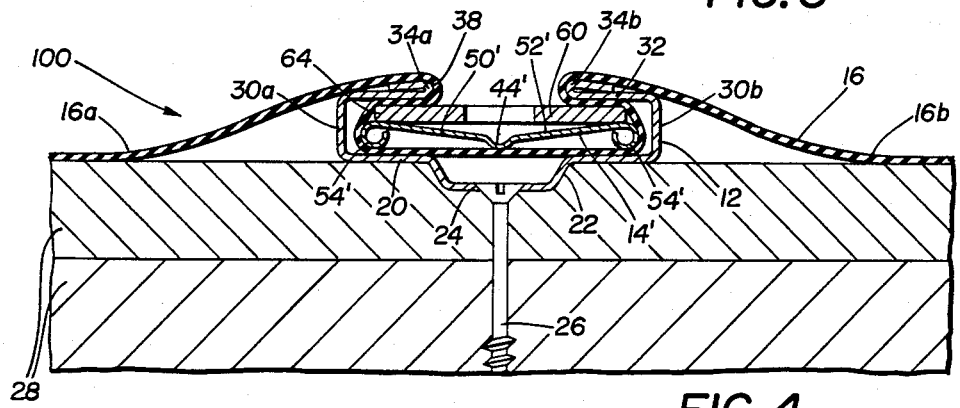
FIG. 4 is a sectional view similar to that of FIG. 3 but showing the locking device of the present invention being utilized with a further embodiment of a membrane fastener apparatus.

Turning now to FIG. 4, there is shown an attachment device 100 which is identical to attachment device 10 except for the use of a different insert member 14', with other like parts being denominated with like numerals used in the description of attachment device 10. Insert member 14' is preferably constructed of a ductile but rigid material such as, for example, galvanized mild steel. Other rigid, preferably metallic materials can also be utilized. Insert member 14', which is of generally inverted V-shape in transverse cross-section (not shown), prior to its installation, has a central longitudinal portion 44' of reduced rigidity that also serves to define two adjacent substantially opposed allochiral wing portions 50', 52' having smoothly, radiused ends 54'. Portions 50' and 52' may be either flat or slightly concavely curved. Portion 44' not only serves to define the two adjacent wing portions 50', 52' but is also of reduced rigidity, which tends to weaken portion 44'. This weakening enhances the plastic deformation of insert member 14' from its inverted V-shape to its installed shape after its insertion, together with flexible sheet 16, into channel member 12.

In terms of installation, after flexible sheet or membrane 16 is placed over channel member 12, inverted V-shape insert member 14' is situated thereabove and in alignment with slot 38. Insert member 14', together with sheet 16 is then pushed or placed vertically to channel member 12 through central opening 38 until sheet 16 touches channel member bottom wall 20. Thereafter, pressure is applied downwardly against portion 44' (forming the apex of the inverted V) to plastically deform insert member 14' from its inverted V-shape to its installed shape—either substantially flat or preferably into a slightly concave shape as shown in FIG. 4. The important thing is that after insert member 14' is received within channel member 12, it must remain either substantially flat or slightly concave since a convex curvature can cause it to be displaced from channel member 12 upon the application of sufficient tensile forces, either parallel and/or perpendicular to top wall 32, on either one or both of membrane ends 16*a*, 16*b*.

As noted previously with reference to attachment device 10, (FIGS. 1–3) the mode of operation of insert member 14' is very similar to that of insert member 14. While it is rather unlikely that there would be a subsequent removal of flexible membrane 16 by the deformation of one of insert and channel members 14' and 16, respectively, the use of locking device 60, previously described with reference to attachment device 10, will of course prohibit the noted removal. The insertion of locking device 60 into attachment device 100 and its subsequent angular displacement, to its locking position, is identical in both attachment devices 10 and 100.

The locking device of the present invention finds specific utility in mechanically securing EPDM sheeting in flat roofing applications. However, from the foregoing description, when read in light of the several drawings, it is believed that those familiar with the art will readily recognize and appreciate the novel concepts and features of the present invention. Obviously, while the invention has been described in relation to only a limited number of embodiments, numerous variations, changes, substitutions and equivalents will present themselves to persons skilled in the art and may be made without necessarily departing from the scope and principles of this invention. As a result, the embodiments described herein are subject to various modifications, changes and the like without departing from the spirit and scope of the invention with the latter being determined solely by reference to the claims appended hereto.

What is claimed is:

1. In an attachment device in combination with a roof and at least one elastic membrane for mechanically securing said membrane to the upper surface of said roof, said attachment device comprising channel member having a generally rectangular cross-section and a continuous, central longitudinal slot opening into said channel member, a bottom wall, an upper wall, and generally opposed sidewalls, said channel member having a width which is defined by said opposed sidewalls; and an insert member comprising means for maintaining said at least one elastic membrane within said channel member, said insert member having an integral central longitudinal portion and two adjacent wing portions located on opposed edges of said central longitudinal portion, said central longitudinal portion defining said two adjacent wing portions, said insert member being either substantially flat or slightly concave and comprising means for frictionally and non-bindingly maintaining said at least one elastic membrance against one wall of said channel member, thereby permitting lateral and vertical shifting of said insert member and said at least one elastic membrane within said channel member, said insert member having a width which is less than said channel member width; one of said insert and channel members being capable of deformation to permit the insertion of said channel member, the improvement comprising the addition of an independent locking device, into said channel member to prohibit the subsequent removal of said elastic membrane by elastic deformation of one of said channel and insert members.

2. The improved attachment device of claim 1 wherein said locking device is rigid and substantially flat.

3. The improved attachment device of claim 2 wherein said locking device includes a rectangular opening for the insertion of a turning tool.

4. The improved attachment device of claim 3 wherein said locking device has a predetermined width that permits close but non-interfering initial insertion into said channel member.

5. The improved attachment device of claim 4 wherein said locking device has a predetermined length greater than its width but less than the width of said channel member so as to permit the angular displacement of said locking device within said channel member.

6. The improved attachment device of claim 1 wherein said locking device is substantially rectangular.

7. In an attachment device in combination with a roof and at least one elastic membrane for mechanically securing said membrane to the upper surface of said roof, said attachment device comprising a substantially rigid channel member having a generally rectangular cross-section and a continuous central longitudinal slot opening into said channel member, a bottom wall, an upper wall, and generally opposed side walls, said channel member having a width which is defined by said opposed side walls; and an insert member comprising means for maintaining said at least one elastic membrane within said channel member, said insert member being formed from a resilient material and having two outer edges which define between them a lateral extent less than the width of said channel member when said insert member is unflexed, said insert member also comprising a central longitudinal flex notch in one surface which defines two adjacent wing portions and which comprises means for facilitating the temporary elastic deformation of said insert member from a first position in which said member has a substantially unflexed natural shape into a second position in which said member has a generally inverted V-shape so that said edges can be inserted, together with a portion of said at least one elastic membrane, through said slot and into said channel member, said insert member and said longitudinal flex notch together comprising means for maintaining said at least one elastomeric sheet against an interior surface of said channel member when said insert member is substantially flattened into a third position in which the shape of said insert member is returned approximately to said natural shape, thereby permitting lateral and vertical shifting of said insert member and said at least one elastic membrane within said channel member, said insert member having a width wherein said third position which is less than said channel member width; the improvement comprising the addition of a rigid locking device, into said channel member, to prohibit the subsequent removal of said elastic membrane by elastic deformation of said insert member.

8. The improved attachment device of claim 7 wherein said locking device has a predetermined width that permits close but non-binding insertion into said channel member and has a predetermined length greater than its width but less than the width of said channel member so as to permit the angular displacement of said locking device within said channel member.

9. The improved attachment device of claim 7 wherein said locking device includes a rectangularly shaped opening for the insertion of a conjugate-shaped turning tool.

10. In an attachment device in combination with a roof and at least one elastic membrane for mechanically securing said membrane to the upper surface of said roof, said attachment device comprising a substantially rigid channel member having a generally rectangular cross-section and a continuous, central longitudinal slot opening into said channel member, a bottom wall, an upper wall, and generally opposed sidewalls, said channel member having a width which is defined by said opposed sidewalls; and an insert member comprising means for maintaining said at least one elastic membrane within said channel member, said insert member being formed from a ductile and rigid material and having an integral central longitudinal portion of reduced rigidity and two adjacent wing portions located on opposed edges of said central longitudinal portions, said central longitudinal portion defining said two adjacent wing portions and comprising means for facilitating a plastic deformation of said insert member from a first position to a second position, said insert member having a generally inverted V-configuration in said first position with said central longitudinal portion being located at the apex of said inverted V, and occupying said second position after undergoing said plastic deformation during insertion of said insert member together with said at least one elastic membrane into said channel member, said insert member being either substantially flat or slightly concave in said second position and comprising means for frictionally and non-bindingly maintaining said at least one elastic membrane against one wall of said channel member, thereby permitting lateral and vertical shifting of said insert member and said at least one elastic membrane within said channel member, said insert member having a width when in said second position which is less than said channel member width; the improvement comprising the addition of a rigid locking device, into said channel member, to prohibit the subsequent removal of said elastic membrane by deformation of one of said insert and channel members.

11. The improved attachment device of claim 10 wherein said locking device has a predetermined width that permits close but non-binding insertion into said channel member and has a predetermined length greater than its width but less than the width of said channel member so as to permit the angular displacement of said locking device within said channel member.

12. The improved attachment device of claim 10 wherein said locking device includes a rectangularly spaced opening for the insertion of a conjugate-shaped turning tool.

* * * * *